United States Patent [19]

Yamana et al.

[11] Patent Number: 4,873,545

[45] Date of Patent: Oct. 10, 1989

[54] METHOD OF DEVELOPING IMAGE ON ELECTROPHOTOGRAPHIC FILM

[75] Inventors: Keiichi Yamana; Masaru Imai; Shuichi Ohtsuka, all of Ashigarakami, Japan

[73] Assignee: Fuji Photo Film Co., Ltd., Kanagawa, Japan

[21] Appl. No.: 230,288

[22] Filed: Aug. 9, 1988

[30] Foreign Application Priority Data

Oct. 24, 1986 [JP] Japan ..... 61-253130

[51] Int. Cl.[4] ..... G03G 15/10

[52] U.S. Cl. ..... 355/256; 430/117; 118/659

[58] Field of Search ..... 355/3 R, 10, 15; 118/652, 659–662; 430/117–119, 125

[56] References Cited

U.S. PATENT DOCUMENTS

| | | | |
|---|---|---|---|
| 3,936,854 | 2/1976 | Smith | 355/10 |
| 4,461,561 | 7/1984 | Plumadore | 355/3 R |
| 4,591,543 | 5/1986 | Outsuka et al. | 430/125 |
| 4,727,393 | 2/1988 | Outsuka et al. | 355/10 |

*Primary Examiner*—Arthur T. Grimley
*Assistant Examiner*—J. Pendergrass
*Attorney, Agent, or Firm*—Sughrue, Mion, Zinn, Macpeak & Seas

[57] ABSTRACT

A developing method for developing an image on an electrophotographic film by means of a processing head which has a developing section to which the film is pressed for the development under the supply of a developer. After completion of supply of the developer to the developing section, weak and strong blasts of air are successively applied and, when the film is moved apart from the developing section, a final strong blast of air is applied, so that surplus residual liquid developer is removed from the developing section without being dried and solidified in the developing section.

10 Claims, 15 Drawing Sheets

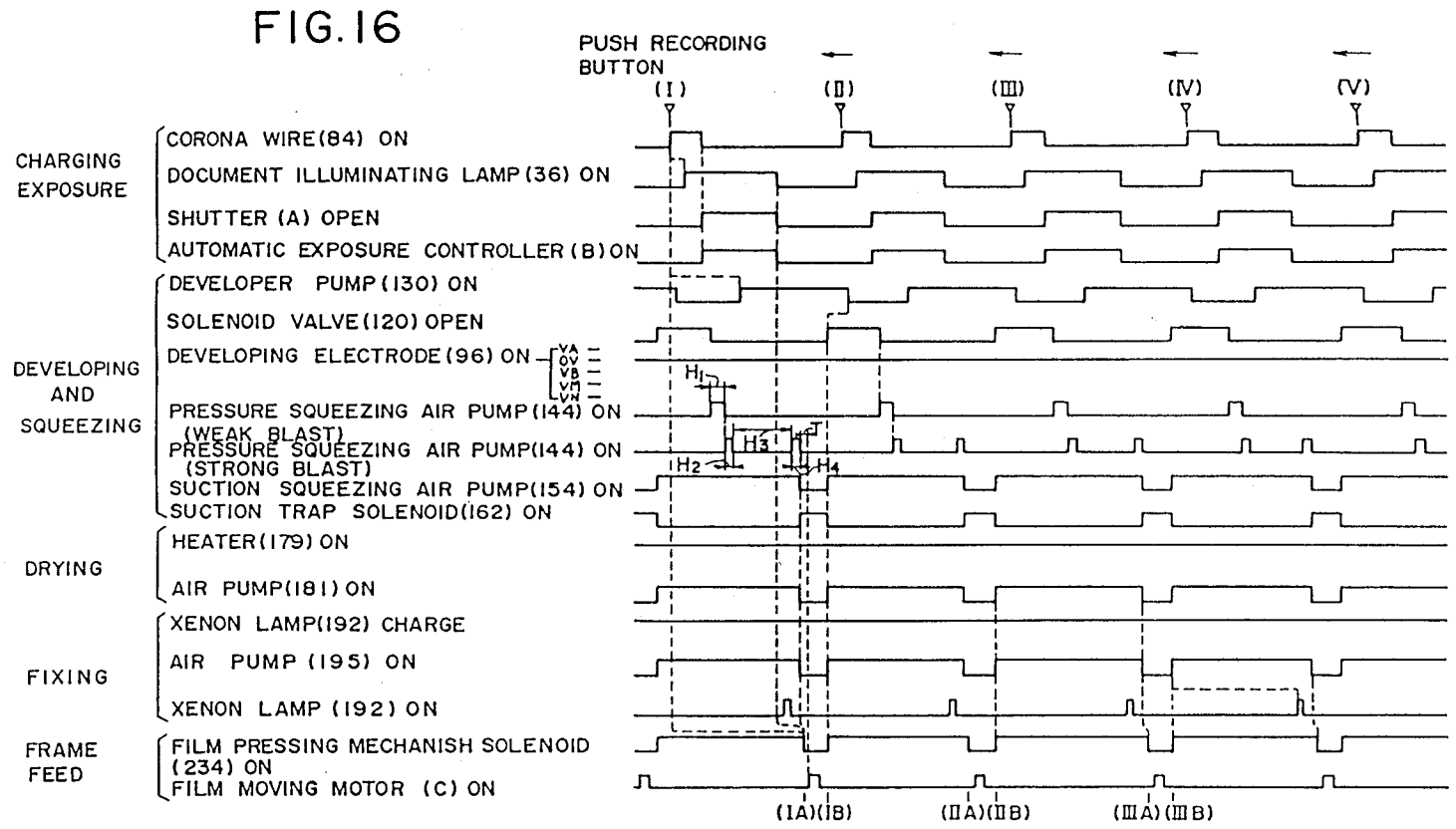
FIG. 16
PUSH RECORDING BUTTON
(I)
(II)
(III)
(IV)
(V)
CHARGING EXPOSURE
CORONA WIRE(84) ON
DOCUMENT ILLUMINATING LAMP(36) ON
SHUTTER (A) OPEN
AUTOMATIC EXPOSURE CONTROLLER (B) ON
DEVELOPING AND SQUEEZING
DEVELOPER PUMP(130) ON
SOLENOID VALVE(120) OPEN
DEVELOPING ELECTRODE(96) ON
VA
VB
VC
VD
VE
PRESSURE SQUEEZING AIR PUMP(144) ON
(WEAK BLAST)
PRESSURE SQUEEZING AIR PUMP(144) ON
(STRONG BLAST)
SUCTION SQUEEZING AIR PUMP(154) ON
SUCTION TRAP SOLENOID(162) ON
H1
H2
H3
H4
DRYING
HEATER(179) ON
AIR PUMP(181) ON
FIXING
XENON LAMP(192) CHARGE
AIR PUMP (195) ON
XENON LAMP (192) ON
FRAME FEED
FILM PRESSING MECHANISH SOLENOID (234) ON
FILM MOVING MOTOR (C) ON
(IA)(IB)
(IIA)(IIB)
(IIIA)(IIIB)

METHOD OF DEVELOPING IMAGE ON ELECTROPHOTOGRAPHIC FILM

BACKGROUND OF THE INVENTION

1. Continuity

This is a continuation-in-part application of U.S. patent application Ser. No. 07/111,736 filed Oct. 23, 1987 now abandoned.

2. Field of the Invention

The present invention broadly relates to a processing head which is designed for effecting various processes on an electrophotographic film in an electrophotographic apparatus. More particularly, the invention is concerned with a developing method for developing images on the electrophotographic film by means of the processing head.

3. Description of the Related Art

Electrophotographic apparatus has been known in which an image is recorded in a predetermined frame of an electrophotographic film in such a manner that the recorded image can be projected or copied as desired.

The electrophotographic apparatus of the kind mentioned above employs a processing head adapted for conducting various processes such as charging, exposure and development on the electrophotographic film. Examples of such a processing head is disclosed in U.S. Pat. Nos. 4,591,543, 4,600,291, 4,613,226, 4,623,240, 4,671,648 and so forth.

The processing head disclosed in the above-mentioned publications has a charging/exposure section, a developing section, a drying section and a fixing section which are arranged in series in the mentioned order along the path of feed of the electrophotographic film, at a pitch or interval which corresponds to the pitch of frames on the electrophotographic film.

In the charging/exposure section, the portion of the electrophotographic film located in this section, constituting one frame, is charged and then exposed to an image light from an original, so that an electrostatic latent image corresponding to the pattern of an image carried by the original is formed in this portion of the film. The film is then fed so as to bring the exposed frame to the developing section where a liquid developing agent is applied to the electrophotographic film so as to develop the latent image thereby making it visible. Subsequently, the frame is brought to the drying section where drying air is blown to the electrophotographic film wetted by the liquid developing agent so as to remove moisture content from the film. Finally, the frame is brought to the fixing section where the developed image is fixed to the electrophotographic film by means of, for example, a fixing lamp.

In this processing head, a considerable amount of the liquid developer, which has been applied to the electrophotographic film after the charging/exposure, undesirably remain in the developing section and the developer supply passage. For the purpose of removing the unnecessary residual developer, therefore, it has been a common practice to apply a blast of air which is also referred to as squeezing air in this specification.

A too low blast air pressure, i.e., a too weak blast air, cannot completely remove the surplus developer attaching to the walls of the developer supply passages and the surface of a developing electrode. It would be possible to forcibly blow off the residual developer by applying a strong blast of air by increasing the air pressure. Such a strong blast, however, undesirably promotes drying and solidification of the surplus developer, rather than blowing the unnecessary portion of the liquid developer off the surfaces to which the developer attaches.

SUMMARY OF THE INVENTION

Accordingly, an object of the present invention is to provide a developing method for developing an image on an electrophotographic film by a processing head incorporated in an electrophotographic apparatus, which is effective in removing any surplus liquid develope attaching to the surfaces of a developing electrode and developer passages in the processing head, without causing drying and solidification of the developer.

To this end, according to the present invention, there is provided a developing method for developing an image on an electrophotographic film by means of a processing head which as a developing section in which the image is developed under the supply of a developer, the method comprising the steps of: (a) pressing the electrophotographic film onto the processing head; (b) supplying the developer to the developing section; (c) applying, for a first predetermined period, a weak blast of pressurized gas to the developing section when the supply of the developer to the developing section is finished; (d) applying, for a second predetermined period, a first strong blast of pressurized gas stronger than the weak blast to the developing section; and (e) applying, for a third predetermined period, a second strong blast to the processing head when the pressing force by which the electrophotographic film is pressed onto the processing head is relieved.

In operation, each of the consecutive frames of the electrophotographic film is pressed onto the body of the processing head so as to be charged and exposed. The frame after the charging/exposure is moved to the developing section of the processing head where a liquid developer is supplied so as to develop a latent image which has been formed on the film as a result of the charging/exposure. The thus developed image is then dried and fixed. As explained before, a certain amount of surplus developer remains in the developing section. In order to get rid of the unnecessary residual developer, a comparatively weak blast of air is supplied to the developed section for a predetermined period. This air blast is so weak that it does not cause the surplus liquid developer to be dried and solidified, but is too weak to completely remove the residual surplus liquid developer, so that a considerable amount of liquid developer still remain attaching to the developing electrode and walls of the developer supply passage. In order to remove this residual liquid developer, a comparatively strong blast of air is applied so as to blow the residual liquid develope off the surfaces of the developing electrode and the developer supply passages.

This strong air blast, however, cannot remove portions of the liquid developer which has clung due to surface tension to the boundary between the electrophotographic film and the mask in the developing section. Therefore, another strong air blast is applied when the electrophotographic film leaves the mask in the developing section. When the electrophotographic film is separated from the mask, the affinity between the liquid developer and the mask and the film is decreased due to a reduction in the surface tension, so that the liquid developer clinging to the mask and the electrophotographic film is blown off.

It is thus possible to remove unnecessary residual liquid developer without allowing the developer to become dry and solidify.

The above and other objects, features and advantages of the present invention will become clear from the following description of the preferred embodiments taken in conjunction with the accompanying drawings.

BRIEF DESCRIPTION OF THE DRAWINGS

FIG. 16 is a time chart showing the operation of the electrophotographic apparatus in camera mode.

DESCRIPTION OF THE PREFERRED EMBODIMENT

(General Construction of Electrophotographic Apparatus)

Figure 1:
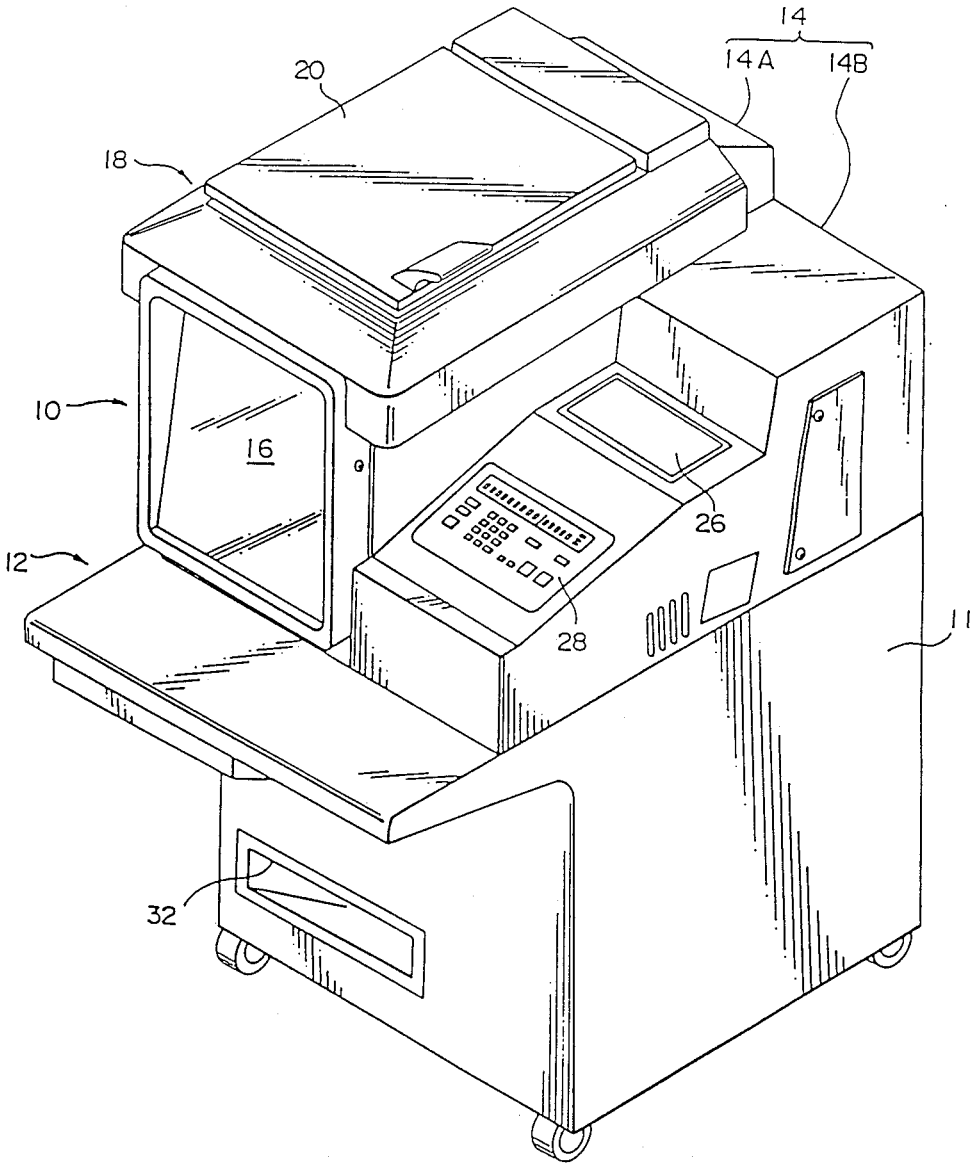
FIG. 1 is a perspective view of an electrophotographic apparatus to which the present invention pertains.

FIG. 1 shows one example of an electrophotographic apparatus having a processing head to which the present invention pertains. The electrophotographic apparatus has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic apparatus has on integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelepiped configuration and a right-hand portion 14B which has a stepped upon surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic apparatus are effected is disposed on the front portion of the upper side of the housing portion 14B.

Figure 4:
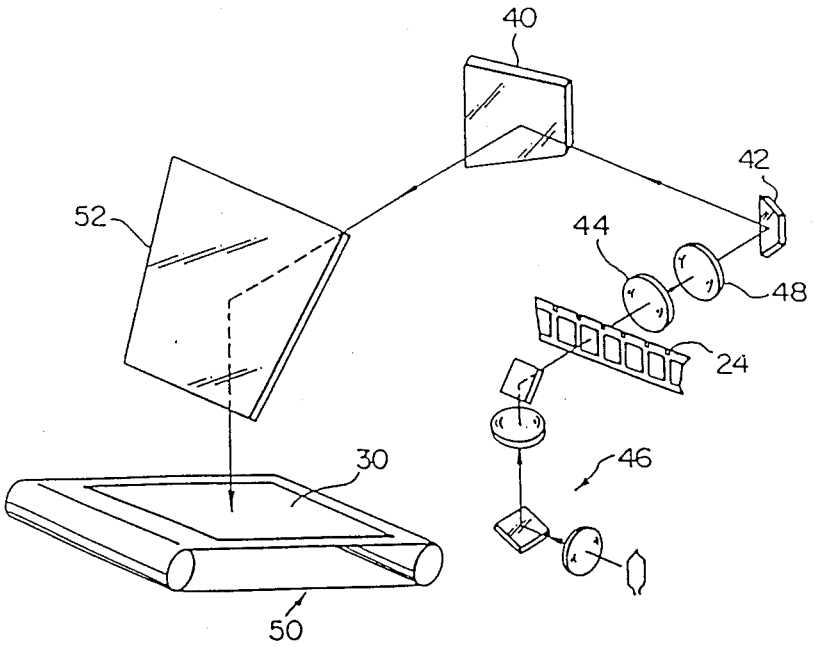
FIG. 4 is perspective view illustrating the concept of a copying optical system in the electrophotographic apparatus.

The housing 11 of the copying machine 12 is provided with an opening 32 for delivering a copied sheet of paper 30 (see FIG. 4).

Figure 2:
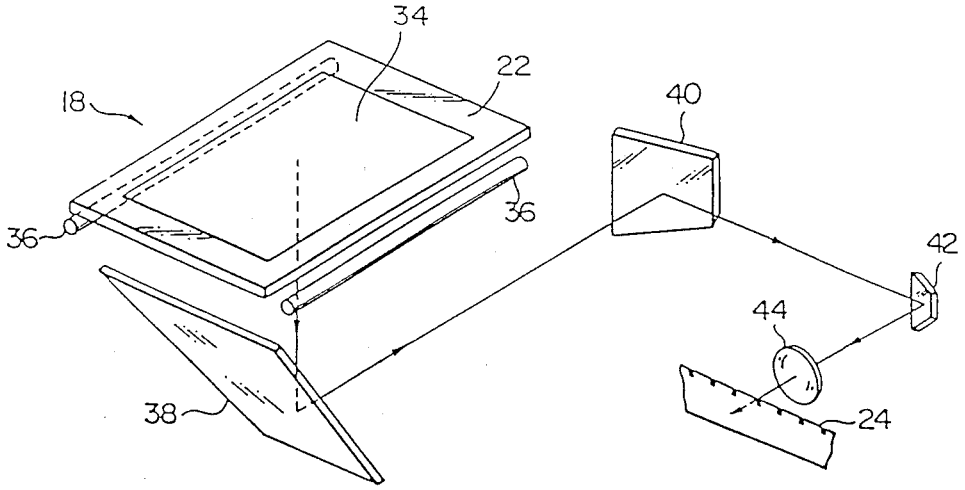
FIG. 2 is a perspective view illustrating the concept of a photographing optical system in the electrophotographic apparatus.
Figure 3:
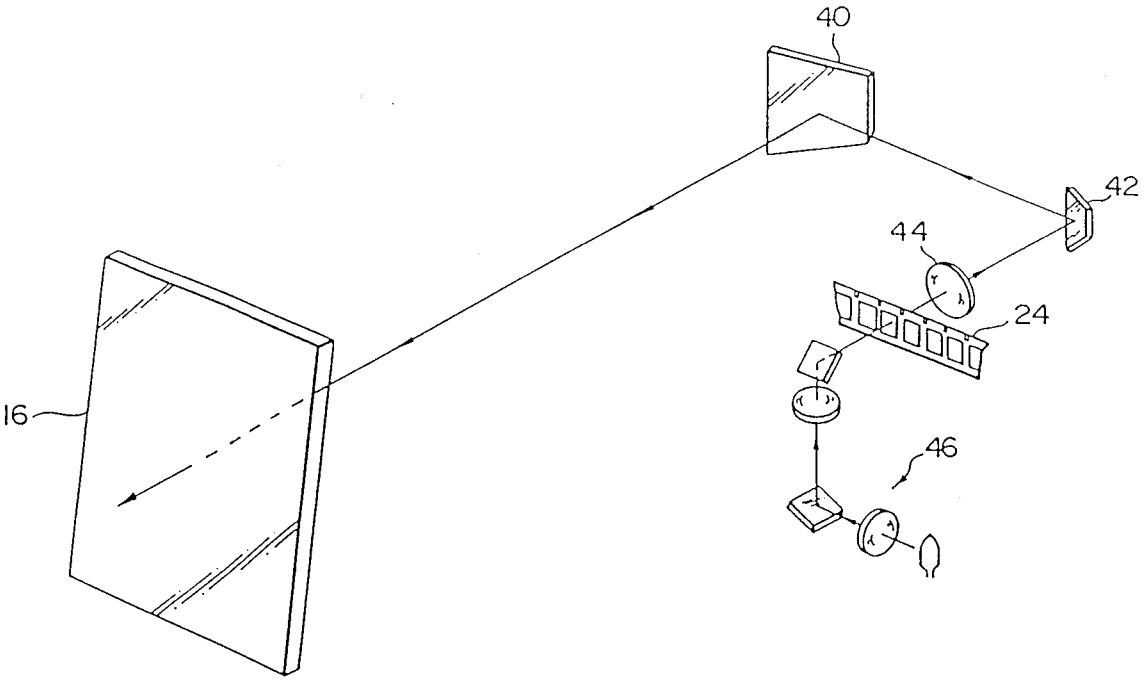
FIG. 3 is a perspective view illustrating the concept of a projecting optical system in the electrophotographic apparatus.

FIGS. 2 to 4 show various optical systems of the electrophotographic apparatus.

Referring first to FIG. 2, the recording optical system includes a document illumination lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected form the second mirror 40 is made incident, and a main lens 44 for focusing the light reflected form the first mirror 42 on the surface of an electrophotographic film 24.

Referring next to FIG. 3, the projecting optical system includes a projecting light source section 46 for irradiating the electrophotographic film 24, the main lens 44 for.focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical system. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical system. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

FIGS. 5 to 13 show in combination one embodiment of the processing head according to the present invention which is disposed in the above-described electrophotographic apparatus.

Figure 6:
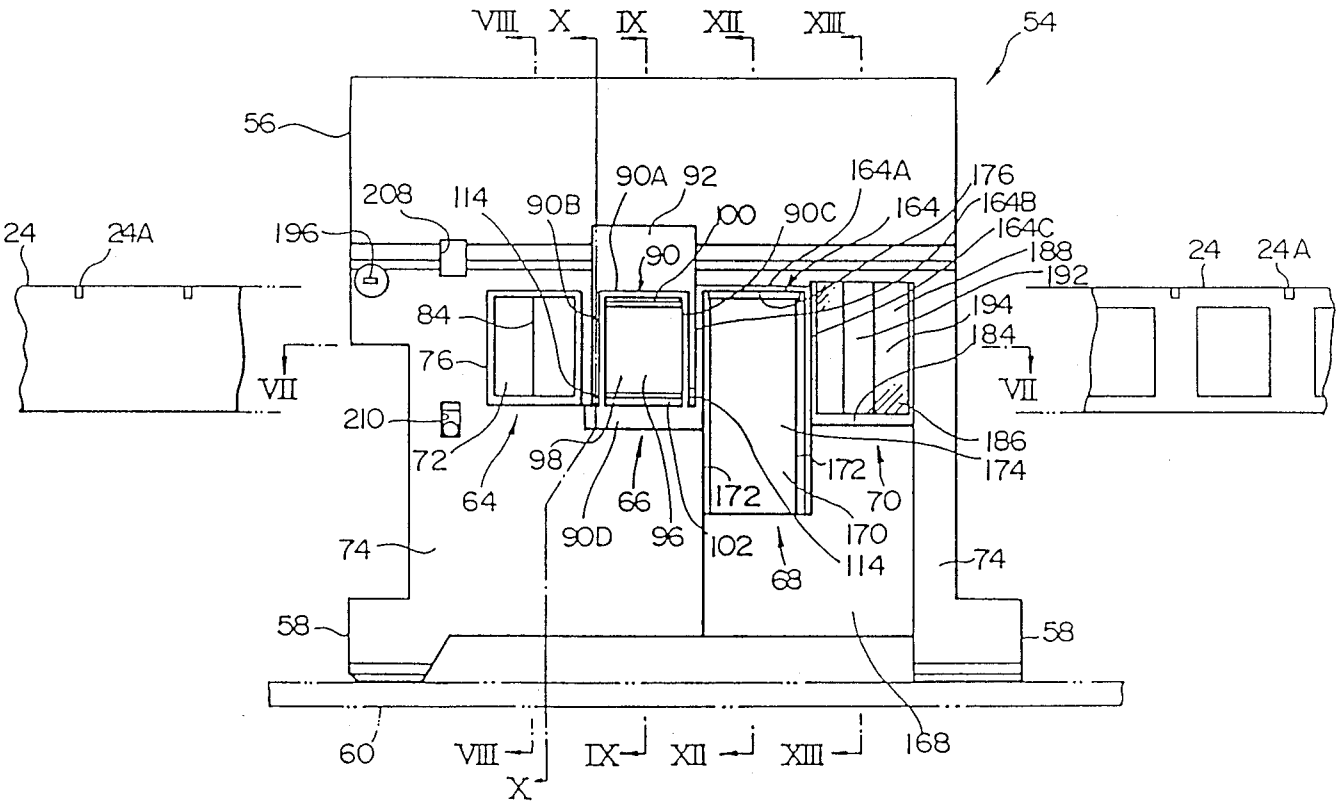
FIG. 6 is a front elevational view of the processing head shown in FIG. 5.
Figure 5:
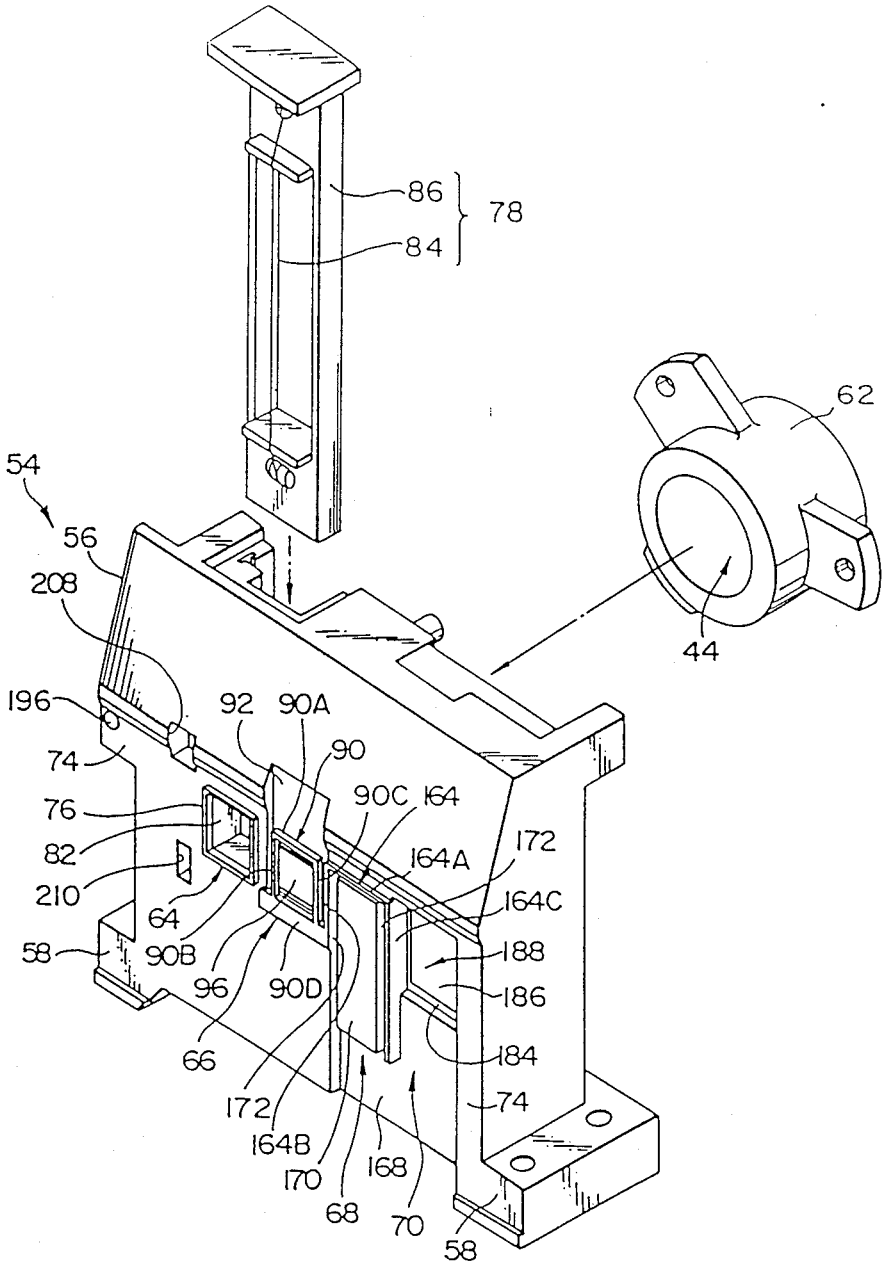
FIG. 5 is an exploded perspective view of a processing head incorporated in the electrophotographic apparatus to which the present invention pertains.

Referring first to FIGS. 5 and 6, the processing head 54 had an integral structure which consists of a relatively flat body portion 56 having a substantially rectangular parallelepiped configuration, and a pair of leg portions 58 located below the body portion 56. The processing head 54 is formed form a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
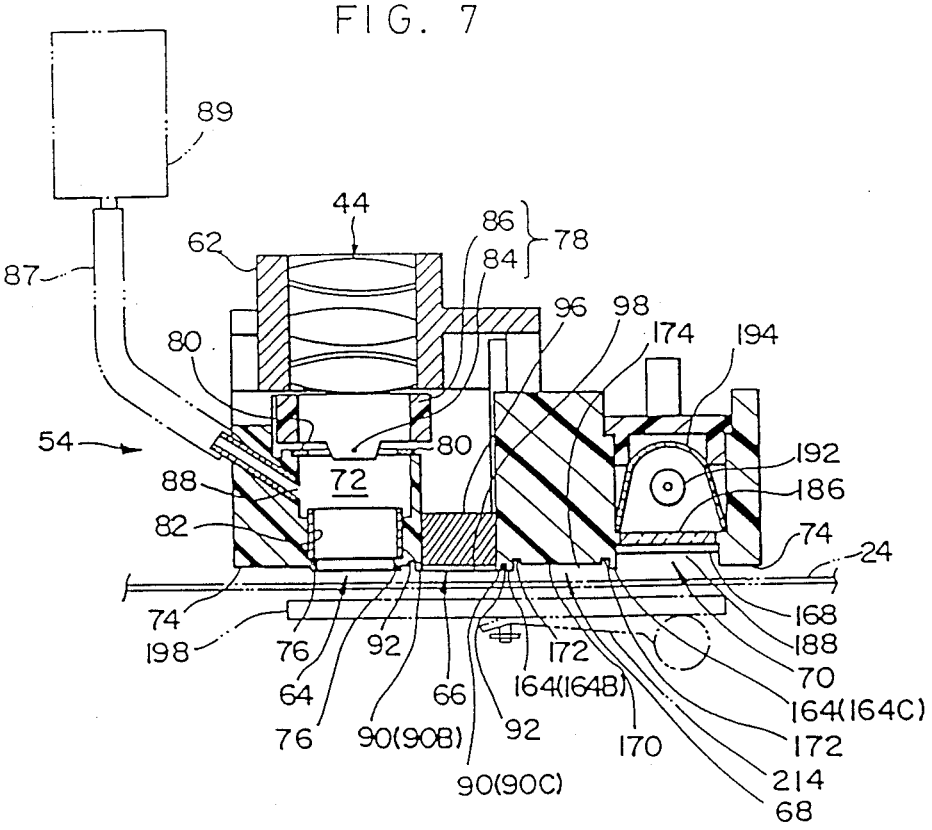
FIG. 7 is a sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrical connection with the apparatus body 10 when the cassette is loaded therein. It is a matter of course that any type of known electrophotographic film may be employed in addition to the film of the type described above.

As shown in FIGS. 5 to 7, a charging exposure section 64, a developing section 66, a drying section 68 and a fixing section 70 are successively formed in the body portion 56 of the processing head 54 along the lateral direction thereof at a constant pitch which corresponds to the frame pitch of the film 24.

Figure 8:
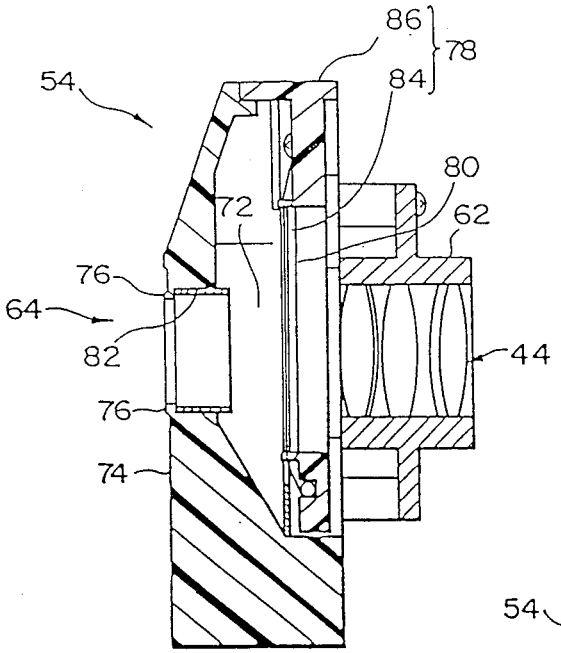
FIG. 8 is a sectional view taken along the line VIII—VIII in FIG. 6.

As shown in FIGS. 7 and 8, the charging exposure section 64 has a charging exposure chamber 72 which is defines by an internal space provided on the reverse side of a front wall 74 of the processing head 54. The chamber 72 is communicated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a pipe 87. The main lens 44, which is mounted on the rear side of the processing head 54 through the lens tube 62, has the optical axis thereof made coincident with the center of the opening defined by the mask 76.

The charging/exposure section 64 has a transversely-extending guide projection 77. The guide projection 77 has the same height as the mask 76 and is intended for preventing, when the electrophotographic film 24 is set in the cassette loading section 26 together with the cassette, the electrophotographic film 24 from being caught by the mask 76 on the front wall 74 of the main part 56 of the processing head 56. To this end, the surfaces on the upper and lower sides are tapered such as to progressively decrease the height.

As shown in FIGS. 5 and 6, the developing section 66 has a mask 90. The mask 90 is defined by an upper frame member 90A, left and right frame members 90B, 90C, and a lower frame member 90D. The upper frame members 90A and the left right frame member 90B and 90C rise from the surface of a recess 92 formed in the front wall 74, and the lower frame member 90D rises from the front wall 74. Both longitudinal end portions of the lower frame member 90D project horizontally from the joints between the frame member 90D and the left and right frame members 90B and 90C. The amount by which the mask 90 projects is set so that the mask 90 is flush with the mask 76.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
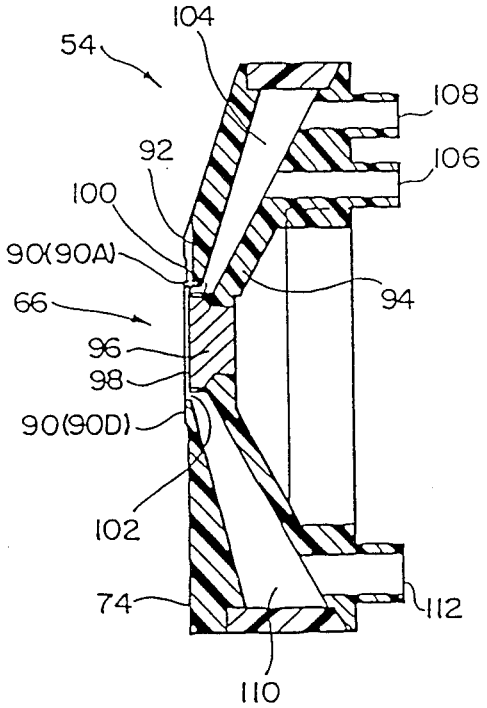
FIG. 9 is a sectional view taken along the line IX—IX in FIG. 6.

As shown in FIG. 9, a developing electrode 96 is disposed within the opening defined by the mask 90, the electrode 96 being supported by a rear wall 94. The developing electrode 96 is connected to a bias power supply. The developing electrode 96 is positioned in such a manner that the outer surface thereof is located at a position which is slightly inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102. The surface of walls of the mask 90 have been finished finely and smoothly so as to ensure a high liquid wipe-off or removing efficiency. The developer and squeezing air inlet 100 is communicated with a passage 104 which is defined by a space inside the processing head 54. The passage 104 is communicated with a developer supply port 106 and a squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
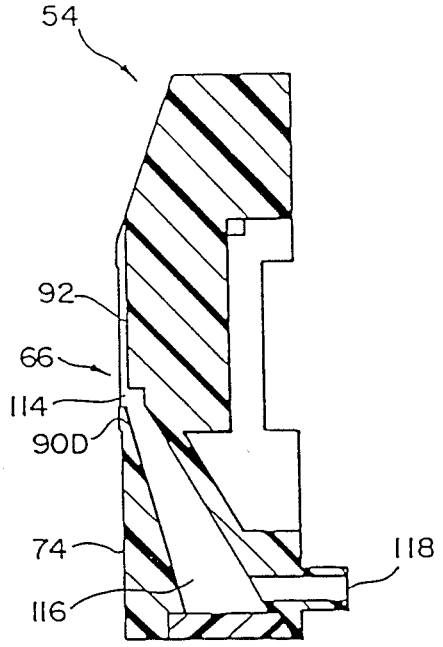
FIG. 10 is a sectional view taken along the line X—X of FIG. 6.

Recesses 92 are respectively provided on the outer sides of the left and right frame members 90B and 90C of the mask 90. As shown in FIGS. 6 and 10, a squeezing suction port 114 is provided at the lower end of each of the recesses 92. The suction ports 114 are, as shown in FIG. 10, communicated with a passage 116 which is defined by a space inside the processing head 54. The passage 116 is communicated with a suction squeeze opening 118 provided in the rear side of the processing head 54.

Referring to FIG. 11(A), the developer supply port 106 is connected to a developer tank 126 through pipes 122 and 124 via a solenoid valve 120. The developer tank 126 is positioned at a level above the solenoid valve 120. A developer pump 130 adapted to be driven by a motor 128 is connected to the developer tank 126 through a pipe 132. The developer pump 130 is disposed in a developer bottle 134 which is charged with a developer 136 formed by toner particles dispersed in a solvent. A return pipe 138 leading to the developer bottle 134 branches from an intermediate pipe 124 between the solenoid valve 120 and the developer tank 126. A return pipe 140 opening to the developer bottle 134 is connected to the developer tank 126.

The squeezing air supply port 108 is connected to a pressure squeezing air pump 144 through a pipe 142. The developer and squeezing air discharge port 112 is connected with a return pipe 146 which opens into the developer bottle 134.

Preferably, a valve (not shown) is disposed in an intermediate portion of the pipe 142 so as to shut-off air when the squeezing is not needed thereby preventing air from unnecessarily entering the developing chamber 98.

As will be explained later in connection with FIG. 16, the squeezing air pump 144 is so designed that it is switchable between two pressure modes: namely, a strong blast mode in which it supplies air of a comparatively high pressure and a weak blast mode in which it supplies air at a comparatively low pressure. The switching of the operation mode of the squeezing air pump may be effected by switching the voltage applied to the motor of the squeezing air pump in two stages.

The supply of the pressurized squeezing air by the squeezing air pump 144 is commenced when the solenoid valve 120 is closed to stop the supply of the developer 136. In the initial period of the supply of the squeezing air, the air is supplied at a comparatively low pressure, i.e., in the weak blast mode, for a period $H_1$ shown in FIG. 16. Preferably, this weak blast is applied for a period of 1 to 3 seconds, more preferably 1.5 second, at an air flow rate of 1 l/min per 1 cm of the width of the space defined by the inner wall surfaces of the mask 90 and the developing electrode 96, i.e., the developing chamber 98. This weak blast of squeezing air effectively wipes off the liquid developer so as to remove unnecessary surplus liquid developer remaining in the developing chamber 98, passage 104 and the passage 110. It is also to be understood that this blast of squeezing air is so weak that it does not substantially promote drying of the surplus liquid developer. Subsequently, in a later part of the operation, a first strong blast of squeezing air is applied for a period $H_2$, practically 0.2 to 2 seconds, preferably 1.0 second, at a flow rate of 4 l/min per 1 cm of the width of the developing chamber 98. This first strong blast of squeezing air effectively removes a part of surplus developer which could not be removed by the weak blast and remaining on the surfaces of the walls of the developing chamber and passages 104, 110, as well as on the surface of the electrode. The period $H_2$ of application of the first strong blast is determined to be shorter than the period $H_1$ of weak blast so as to avoid deposition of solidified developer due to rapid drying of the surplus liquid developer by the first strong blast of squeezing air.

It is necessary that the flow rates and periods of application of the weak blast and the first strong blast be determined such that the surplus liquid developer on the electrophotographic film is sufficiently removed without causing the developing electrode 96 to become dry, by the weak blast and the subsequent first strong blast of squeezing air. The flow rates and the application periods specifically mentioned above are those suitably employed with a liquid developer which is formed by dispersing a developing agent available as "Isoper G" from Esso Kabushiki Kaisha in a mixture solvent of isoparaffin having a distillation temperature of 158° to 177° C. Therefore, when a different type of solvent is used as the dispersion medium, the air flow rates and the application periods should be suitably determined in accordance with the state of drying of the developing electrode 96 and the developer on the electrophotographic film.

The supply of air to the developing chamber 98 is suspended when the first strong blast is terminated. The period $H_3$ of suspension shown in FIG. 16 is set according to the interval between successive processing of the recording button and, hence, is variable between a short period shorter than 1 second and a long period exceeding several minutes. The electrophotographic film is held in close contact with the mask 96 of the developing chamber by the pressing plate throughout the suspension period $H_3$, so that the liquid developer still remains on the developing electrode 96 without being dried. It has been confirmed that, when the aforementioned Isoper G is used as the dispersion medium, the developing electrode 96 remains wetted for a period longer than 10 minutes.

When the interval between the completion of application of the first strong blast and the start of movement of the electrophotographic film is long, the surplus developer which has attached to the surfaces of the wall around the developer inlet of the developing chamber tends to flow towards edge portions formed by the edges of the electrophotographic film and the developing mask 90 so as to accumulate on these edge portions. Feeding of the electrophotographic film to the subsequent drying step together with the thus accumulated liquid developer causes inconvenience such as a drying failure.

In order to remove the liquid developer accumulating on the edge portions formed by the edges of the mask and the film, therefore, a second strong blast of air is applied for a period $H_4$ immediately before the movement of the electrophotographic film is commenced. Practically, the period $H_4$ of application of this second blast of air is selected to range between 0.2 and 1 second, preferably 0.5 second. This second strong blast of air effectively removes the liquid developer accumulated in the edge portions between the electrophotographic film and the mask 90 of the developing chamber. This in turn minimizes the amount of the liquid developer which is unnecessarily brought into the drying section, thereby shortening the time required for the drying.

The air flow rate and the period of the second strong blast also are determined so as not to allow the developing electrode to become dry.

When the frame after the development has been brought into the drying section, the next frame with undeveloped image is brought to the developing section and the above-described developing operation is conducted again so as to develop the image on this frame.

As will be understood from the foregoing description, in the developing method of the invention, the developing electrode 96 is maintained in wet condition so that deposition of solid content of the toner on the electrode 96 is remarkably decreased.

As shown in FIG. 11(B), the suction squeeze opening 118 is connected to a suction trap 150 through a pipe 148. The suction trap 150 is connected to a suction squeezing air pump 154 through a pipe 152. A return pipe 156 which opens into the developer bottle 134 is connected to the bottom of the suction trap 150. A valve 158 which is able to close the return pope 156 is disposed at the joint between the suction trap 150 and the return pope 156. The valve 158 is moved vertically by the action of solenoid 162 through a shaft 160.

Figure 11:
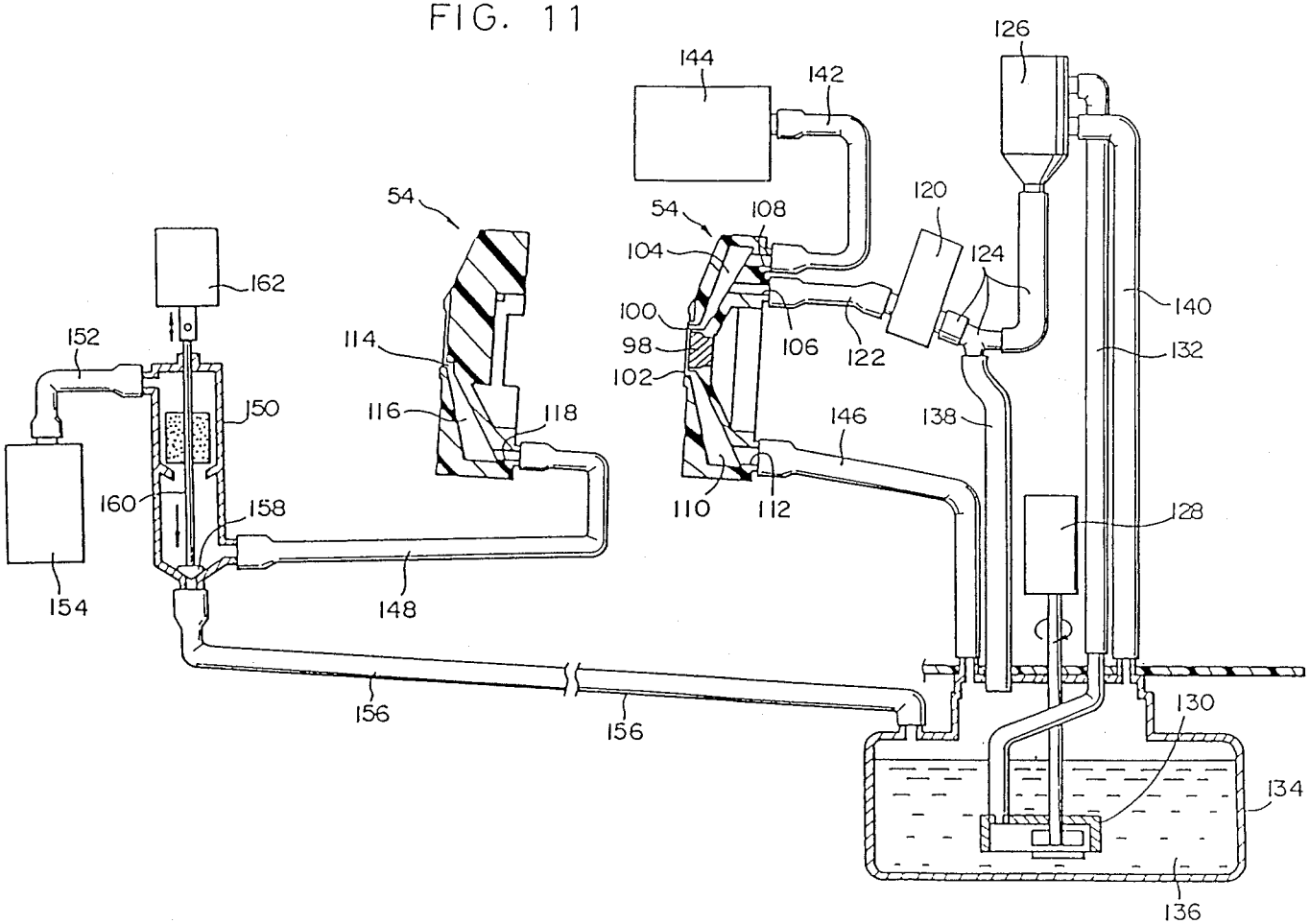
FIGS. 11A and 11B are illustrations of a developing section in the processing head in relation to other devices.

It should be noted that, as shown in FIG. 11, the processing head 54 is inclined with respect to the horizontal plane so that the optical axis of each of the optical systems is perpendicular to the surface of the screen 16 which is slanted.

Referring to FIGS. 5 and 6, the drying section 68 has a frame 164. The frame 164 consists of an upper frame member 164A and left and right frame members 164B and 164C and has no lower frame member. The left frame member 164B is contiguous with the right-hand end portion of the lower frame member 90D of the mask 90 and rises from the front wall 74 together with the upper frame member 164A. The right frame member 164C rises from a recess 168 which is depressed from the front wall 74 in the shape of a step.

Figure 12:
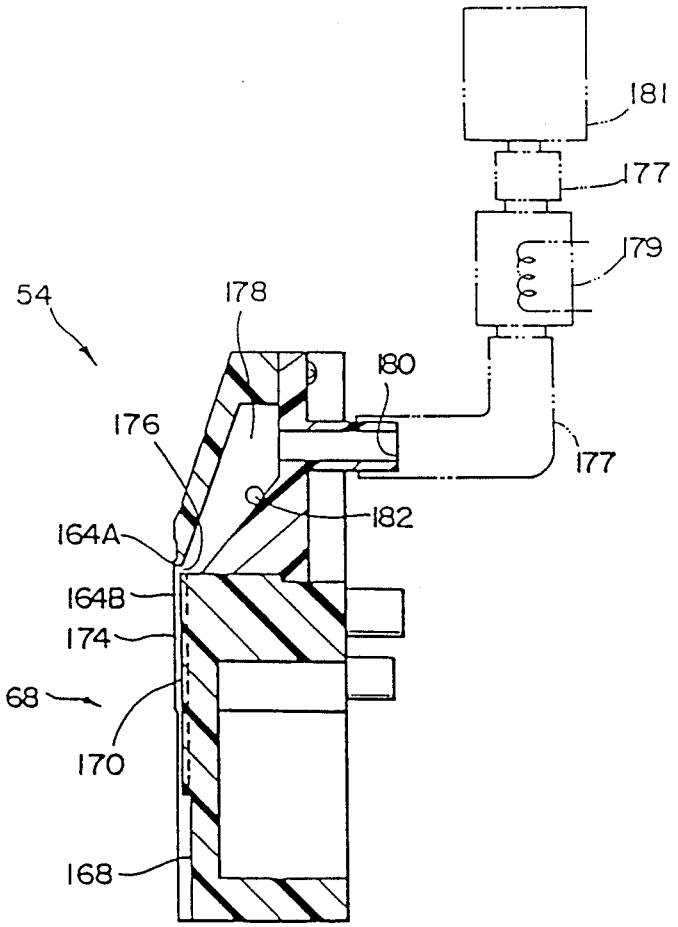
FIG. 12 is a sectional view taken along the line XII—XII of FIG. 6.

As shown in FIGS. 7 and 12, a wall 170 is formed between the left and right frame members 164B and 164C in such a manner that the surface of the wall 170 is located at a position which is slightly inner than the end face of the frame 164. In addition, recesses 172 are formed on both sides of the wall 170. The bottom surface of each recess 172 is raised from the wall surface of the recess 168 in the front wall 74. The space surrounded by the frame 164, the wall 170, and the recesses 172 defines a drying chamber 174. The distance between the opposing lateral inner surfaces of the frame 164 is set such as to be larger than the width of the opening defined by the mask 90. In addition, the lower surface (the frame inner surface) of the upper frame member 164A is positioned above that of the mask 90 in the developing section 66.

As shown in FIGS. 6 and 12, the lower portion of the upper frame member 164A is cut in the shape of a slit along the longitudinal direction of the frame member 164A, thereby providing a warm air outlet 176. The warm air outlet 176 is, as shown in FIG. 12, communicated with a passage 178 which is defined by a space inside the processing head 54. The passage 178 is communicated with a warm air supply port 180 which is provided in the rear side of the processing head 54. A temperature sensor 182 is disposed in the passage 178. The warm air supply port 180 is connected to a heater 179 and an air pump 181 through a pipe 177.

[Fixing Section]

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
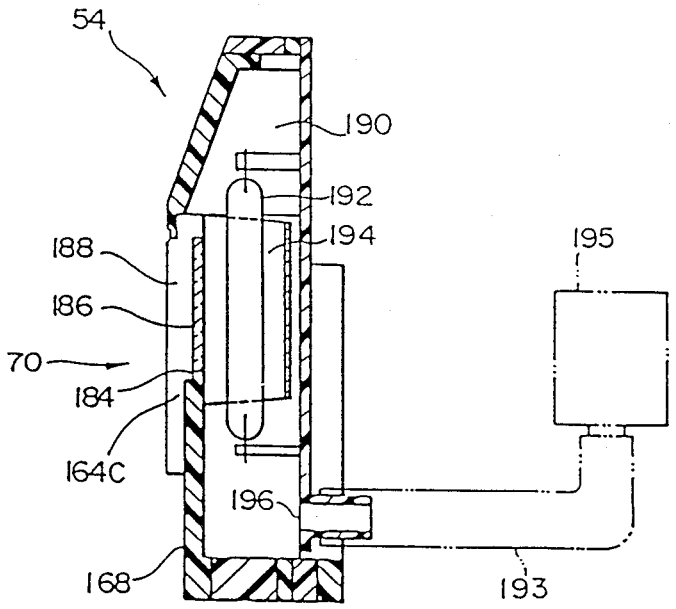
FIG. 13 is a sectional view taken along the line XIII—XIII of FIG. 6.

As shown in FIG. 13, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pope 193. The space 190 and the fixing chamber 188 are communicated with each other through the area defined at the upper edge of the glass plate 186.

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

Figure 14:
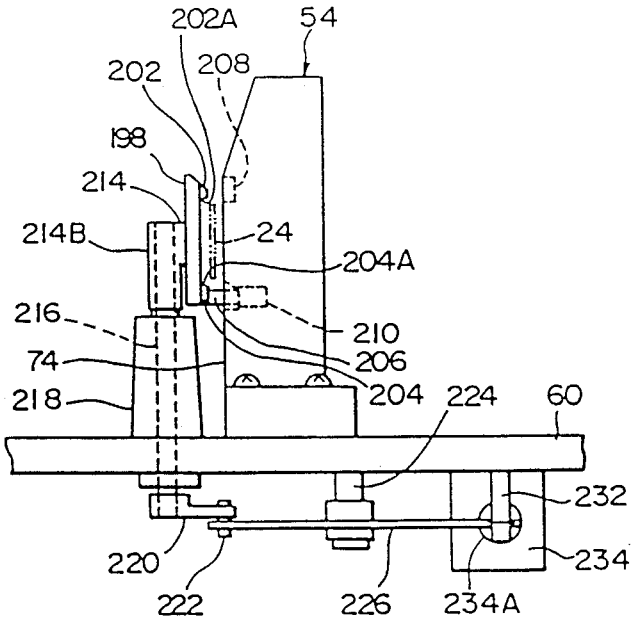
FIG. 14 is a schematic side elevational view of an essential portion of the present invention, illustrating the positional relationship between the processing head and a pressing plate.

As shown in FIGS. 7 and 14, a pressing plate 198 serving as the film pressing means is disposed in front of the front wall 74 of the processing head 54. The pressing plate 198 is, as shown is FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 15A:
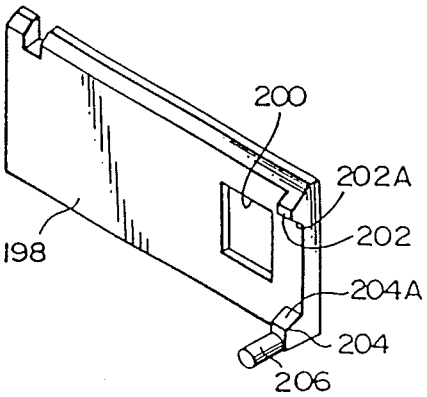
FIG. 15A is a perspective view of a portion of the film pressing mechanism as seen from the opposite side to FIG. 15.
Figure 15:
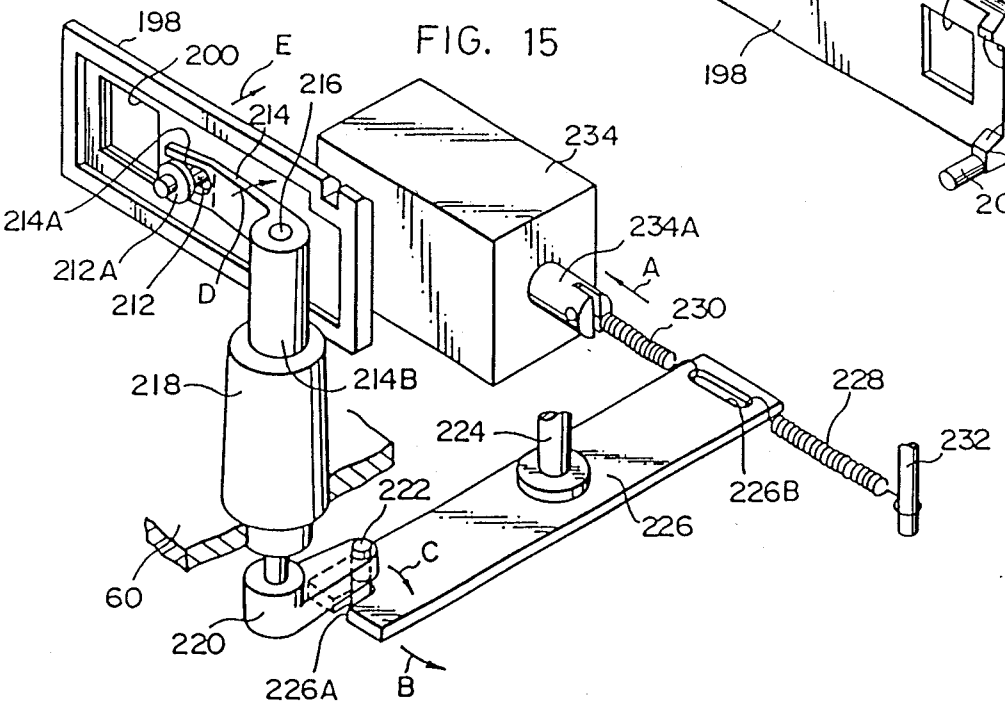
FIG. 15 is a perspective view of a film pressing mechanism provided on the processing head.

As will be seen from FIG. 15A which is a perspective view of the pressing plate 198 from the side opposite to FIG. 15, the pressing plate 198 is provided with claws 202, 204 which project towards the processing head 54 from upper and lower portions of the end of the pressing plate opposite to the end having the through-hole 200. The claws 202 and 204 are so shaped as to have opposing slanted surfaces 202A and 204A, and are spaced from each other such that the distance between these claws as measured at the base portions of these claws is substantially the same as, more precisely slightly greater than, the width of the electrophotographic film 24. A columnar projection 206 is formed on the end of the claw 204. The claws 202 and 204 are adapted to be received in holes 208, 210 (see FIGS. 5, 6 and 14) formed in the front wall 74 of the processing head 54.

The pressing plate 198 is provided on the side thereof opposite to the processing head 54 with a columnar projection 212. A notch 214A formed in one end of the arm 214 engages with this columnar projection 212. A stopper ring 212 is fixed to the end of the columnar projection 212 so as to prevent the notch 214 from coming off. The arm 214 is provided on the other end thereof with a boss portion 214B to which is fixed a shaft 216.

The shaft 216 is rotatably received in a hole formed in a stand 218 which stands upright from the frame 60 to which the processing head 54 is attached. The lower end of the shaft 216 projects beyond the underside of the frame 60. A first lever 220 is fixed to the lower end of the shaft 216. A pin 222 is fixed to the end of the first lever 220.

On the other hand, a shaft 224 depends from the reverse side of the frame 60. The shaft 224 rotatably supports a second lever 226 at an intermediate portion of the latter. The second lever 226 is provided in one end thereof with a notch 226A which engages with the pin 222 mentioned before. The second lever 226 also is provided in the other end thereof with a slot 226B which retain one ends of a pair of coiled tensile springs 228, 230 so that the second lever 226 is resiliently supported by these springs.

The other end of the tensile coiled spring 228 is retained by a pin 232 which depends from the reverse side of the frame 60, while the other end of the other tensile coiled spring 230 is retained by a plunger 234A of a pull-type solenoid 234 which is attached to the reverse side of the frame 60.

When the solenoid 234 is not energized, the pressing plate 198 is held apart from the processing head 54. In this state, as shown in FIG. 14, the pressing plate 198 is supported at its columnar portion 206 which is received in the hole 210 formed in the processing head 54.

As the solenoid 234 is energized, the plunge 234A is moved in the direction of the arrow A so that the tensile coiled springs 228, 230 are stretched against the biasing force. This in turn causes the second lever 226 to rotate about the shaft 224 in the direction of the arrow B, so that the first lever 220 is rotated as indicated by an arrow C through the action of the pin 222, thereby rotating the shaft 216 in the same direction. The rotation of the shaft 216 causes the arm 214 to be rotated in the direction of the arrow D, thereby urging the pressing plate 198 ass indicated by an arrow E.

The pressing plate 198 is therefore moved in the direction of the arrow E with its columnar portion 206 guided by the hole 210, so as to bring the electrophotographic film 24 into resilient contact with the end surfaces of the masks 76, 90 and the frame walls 164. During this movement of the electrophotographic film 24 into contact with the wall surfaces, any vertical misalignment of the electrophotographic film 24 is corrected because the opposing slant surfaces 202A and 204A of the claws 202 and 204 serve as guides so as to urge the upper edge of the film downward or the lower edge of the same downward, thereby to enable the electrophotographic film to be correctly aligned with the predetermined set position.

The pressing plate 198, when it holds the electrophotographic film 24 in contact with the processing head 54, is correctly positioned with respect to the processing head 54 because the claws 202 and 204 are received in the holes 208 and 210. In this state, the pressing plate 198 resiliently presses the electrophotographic film 24 onto the processing head by the action of the tensile coiled springs 228 and 230.

When the solenoid 234 is de-energized, the second lever 226 is rotated in the direction of the arrow B by the force of the tensile coiled spring 228, so that the arm 214 is rotated in the direction of the arrow D. As a result, the notch 214A presses the stopper ring 212 thereby causing the pressing plate 198 to be moved in the direction of the arrow E.

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26, is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in from of the mask 76 in the charging exposure section 64. This operation is executed by designated a desired frrame through the control keyboard 28 shown in FIG. 1. The positioning of the selected frame with respect to the charging exposure section 64 is effected by virtue of the blip sensor 196 which counts the number of blip marks 24A from a reference point.

FIG. 16 is a time chart showing the operation of the apparatus in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 16 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging-/exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) in FIG. 16, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11 (A) is activated to start the operation of the developer pump 130, whereby the developer 136 in the developer bottle 134 is pumped up into the developer tank 126. The developer 136 thus pumped falls from the developer tank 126 by the force of gravity towards the processing head 54 through the pipe 124. In this state, however, the solenoid valve 120 is still kept closed so that the developer 136 is returned to the developer bottle 134 via the return pipe 138. When the level of the developer 136 in the developer tank 126 is raised to a predetermined limit, the developer 136 is returned to the developer bottle 134 through the return pipe 140.

Thus, the developer 136 is circulated between the developer bottle 134 and the developer tank 126 and is stopped at the upstream side of the solenoid valve 120 until the solenoid valve 120 is opened. This recirculation produces an appreciable stirring effect on the developer 36 in the developer bottle 134.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times. When a predetermined period of time has elapsed after the recording button had been pressed and all the steps of processing other frames have already been completed, the solenoid 234 of the film pressing mechanism is immediately de-energized. When the solenoid 234 is de-energized at the position (IA) in FIG. 16, the pressing plate 198 is separated form the film 24.

When a predetermined period of time has elapsed after de-energization of the solenoid 234 of the film pressing mechanism, the film moving motor (not shown but indicated at C in FIG. 16) is started so as to effect a one-frame feed of the photographic film 24 rightward as viewed in FIG. 6. In consequence, the frame which has been positioned in the charging/exposure section 64 is moved to the developing section 66. The feed of the electrophotographic film 24 is controlled in accordance with the signal from the blip sensor 196 capable of sensing the blip mark 24A.

When a predetermined time has elapsed after the stop of the film moving motor C, the solenoid 234 of the film pressing mechanism is energized at a moment (IB) in FIG. 16, thereby causing the pressing plate 198 to press the electrophotographic film 24 onto the processing head 54. At the same time, suction through the suction squeeze opening 118 is commenced and the solenoid valve 120 is opened.

When the solenoid valve 120 is opened, the developer 136 is allowed to reach the processing head 54 through the pipe 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return pipe 146.

The diameters of the pipes and other parameters of the developer supply system are so determined that the developer supplied from the developer tank 126 to the pipe 124 is partially returned to the developer bottle 134 through the return pipe 138, while the remainder part of the developer is directed to the solenoid valve 120.

Since the electrophotographic film 24 is pressed by the pressing plate 198 onto the end surface of the mask 90, there is no risk for the developer 136 flowing down through the developing chamber 98 to come into the gap between the end surface of the mask 90 and the electrophotographic film 24. Any portion of the developer 136 which has come into this gap is sucked and trapped in the suction trap 150 through the suction port 114 and the pipe 148 by vacuum which is generated in recesses 92 on both sides of the left and right frames 90B, 90C of the mask by the operation of a suction squeezing air pump 154.

When a predetermined time has elapsed after the energization of the solenoid 234 of the film pressing mechanism, the motor 128 is stopped so that the developer pump 130 stops to operate. The solenoid valve 120, however, is kept open even after te stop of operation of the developer pump 130. Since the supply of the developer from the developer tank 126 into the processing head 54 is effected by the force of gravity, the developing chamber 98 is continuously supplied with the developer 136 even after the stop of operation of the developer pump 130, because the solenoid valve. 120 is kept open. This supply of the developer after the stop of the developer pump 130 minimizes the risk for the exposure of the next frame of the film to be impaired by vibration of the developer pump 130.

When a predetermined period of time has elapsed after opening of the solenoid valve 120, the solenoid valve 120 is closed so as to stop the supply of the developer 136 to the developing chamber 98. At the same time, the pressure-squeezing air pump 144 is started so that pressurized air is supplied into the developing chamber 98 through the developer/squeeze air inlet 100, thereby blowing any excessive developer 136 off the electrophotographic film 24. The developer 136 thus blown off the electrophotographic film 24 is returned to the developer bottle 134 via the developer/-squeeze air outlet 102 and through the return pipe 146.

As explained before, the supply of the pressurized air to the developing chamber 98 is controlled such that, in the beginning period $H_1$ (see FIG. 16) in which a large quantity of the liquid developer 136 stays in the developing chamber 98, the weak blast of air is applied to squeeze or wipe off the liquid developer. This blast of air is so weak that it does not cause any degradation in the developed image which may be caused if a strong air blast is applied. After the elapse of the period $H_1$, the first strong blast of air is applied for the period $H_2$, so that any surplus developer attaching to the walls of the developing chamber 98 and passages 104, 110 is blown off. The period $H_2$ for which the first strong blast is applied is selected to be shorter than the period $H_1$, so that drying and solidification of the developer do not occur during the application of the first strong blast.

After the completion of the application of the first air blast, the supply of air is suspended for a period $H_3$, before the application of the second strong blast, which is conducted for the period $H_4$, is commenced. Therefore, the undesirable drying of the developing electrode 96 is prevented even if the interval between successive feeds of the electrophotographic film, i.e., the interval of successive operations of the recording button, is long, whereby deposition of solidified developer on the developing electrode is avoided.

The application of the second strong blast of air is conducted for the following reason.

When the film 24 is moved, that is, when the film moving motor (c) is driven, the developer 136 remaining in the developer supply port 106 and/or the developer and squeezing air inlet 100 leaks out to attach to the film 24 partially, so that the uniform drying of the film 24 is prevented in the next drying step, which results in uneven development.

Accordingly, the remaining developer is removed by the application of the second strong blast a little before the movement of the film 24, so that the developer 24 is prevented from leaking out when the film 24 is moved.

Also, the period H4 of the application of the second strong blast of air is set to the range which enables the removal of the developer remaining in the developer supply port 106 and/or the developer and squeezing air inlet 100. Practically, the period H4 is selected to the range between 0.2 and 1 second, as explained above.

If a too long period H4 is selected, the developer attaching to the film 24 is dried partially, which results in uneven developing.

The application of the air blast is controlled by the charging exposure step for a subsequent frame which has been started in response to the pressing of the recording button at the position (II) in FIG. 16.

Also, the film moving motor (c) is driven when the predetermined period of time T has elapsed after the application of the second strong blast of air has been suspended, as shown in FIG. 16. It is to be noted that the solenoid 234 of the film pressing mechanism is deenergized at the position (IIA) in FIG. 16 before the film moving motor (c) is driven. If a too long period of time T is selected, the developer may leak out again, because it takes a certain duration of time until the developer ceases from leaking out of the developer supplying port 106. Accordingly, the period of time T should be set to at most 1 second or so.

It should be noted that the presence of the developing electrode 96 during the developing operation enables obtaining of an image having no edge effect.

When the drive of the film moving motor (C) is suspended, the film 24 has been moved rightwardly as viewed in FIG. 6 by an amount corresponding to one frame, so that a frame which has been positioned at the developing section 66 is now positioned at the drying section 68. When a predetermined period of time has elapsed after the drive of the film moving motor (C) has been suspended, the solenoid 234 of the film pressing mechanism is energized at the position (IIB) in FIG. 16 and, at the same time, the air pump 181 shown in FIG. 12 is activated so that the air heated by the heater 179 is blown into the drying chamber 174 from the warm air outlet 176 in the drying section 68, and the developer 136 is thereby dried. The operation of the air pump 181 is controlled by the charging exposure step which is started when the recording button is pressed at the position (III) in FIG. 16, and suspended at the same time as the solenoid 234 of the film pressing mechanism is deenergized at the position (IIIA) in FIG. 16, thus completing the drying step.

The temperature of the warm air which is supplied to the drying chamber 174 is detected by the temperature sensor 182 and a control is effected in response to the output of this sensor so that, when the air temperature has deviated a predetermined temperature range, a message indicating such a fact is displayed on the control keyboard 28. If the deviation of the air temperature is taking place in the higher temperature side, the supply of the electric power to the heater 179 is stopped without delay.

Although in the above-described embodiment the drying air pump 181 is activated in response to the energization of the solenoid 234 of the film pressing mechanism and only when the film 24 is being pressed against the processing head 54, the air pump 181 may be operated at all times from the start of the operation of the apparatus.

After the solenoid 234 of the film pressing mechanism has been de-energized at the position (IIIA) in FIG. 16, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 16 and, at the same time, the air pump 195 shown in FIG. 13 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the apparatus according to this embodiment, when the recording button is pressed, recording is started, and after the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 16.

When the recording button is not pressed during said period, or when the command to end a series of recording operations is input from the control keyboard 28, the application of a relatively strong blast by the air pump 144 is suspended in accordance with the operation of a timer, and the drying and fixing operations carried out thereafter are also executed in accordance with the timer.

It is possible to project the film 24 having images of documents recorded thereon as described above, when the reader mode is selected. The electrophotographic apparatus to which the described embodiment of the invention is applied is constructed such that the reader mode is automatically selected when the cassette is mounted in the apparatus, by retracting the third mirror 38 from the position shown in FIG. 2 to a suitable position. When a given frame is moved to and stopped at the charging exposure section 64 by an operation similar to the above, the light source of the projecting light source section 46 shown in FIG. 3 is turned ON, and the light from the light source is passed through the through-hole 200 provided in the pressing plate 198 and transmitted by the film 24, and the image recorded on the film 24 is projected on the screen in a greater scale 16 by the optical system shown in FIG. 3.

In addition, the air pump 89 shown in FIG. 7 is started simultaneously with the turning on of the light source, so that cold air is supplied to the charging exposure chamber 72 so as to prevent overheating of the electrophotographic film 24 due to the heat of the projecting light, thereby preventing any out-of-focus state which may be caused by a thermal distortion of the film.

In the reader mode, it is possible to continuously view projected images of the film 24 within a shout period of time by successively advancing the film 24 for each frame through the control keyboard 28. In such case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown is FIG. 4.

In the described embodiment, the developer 136 in the developer bottle 134 is temporarily stored in the developer tank 126 and is supplied to the developing section as the solenoid valve 120 is opened. This arrangement, however, is only illustrative and the arrangement may be such that the developer 136 is directly fed from the developer bottle 134 to the developing section by the operation of the developer pump 130. In such a case, the developer which is being returned through the return pipe 140 branching from an intermediate portion of the pipe 132 is detected by a detector (not shown) and the voltage of the power supplied to the motor 128 is controlled in accordance with the signal from this detector.

In the above embodiment the film moving motor (c) is controlled so as to be driven when the period of time T has lapsed after the application of the second strong blast of air has been suspended.

Figure 17:
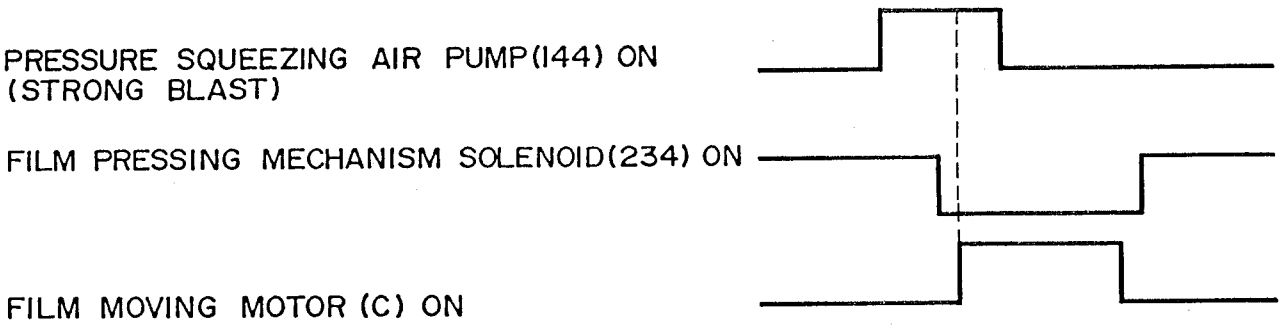
FIG. 17 is a time chart showing the relationship between the operation of the pressure squeezing air pump (144) and the frame feed step in another aspect of camera mode.

This arrangement, however, is only illustrated and it may be such that the de-energization of the solenoid 234 of the film pressing mechanism and the driving of the film moving motor (c) and conducted during the application of the second strong blast of air, as shown in FIG. 17.

In such a case, since the film 24 is applied with the second strong blast of air while it is being moved, it is vibrated, which results in a wrong influence on detection of the blip marks printed on the film 24.

Figure 18:
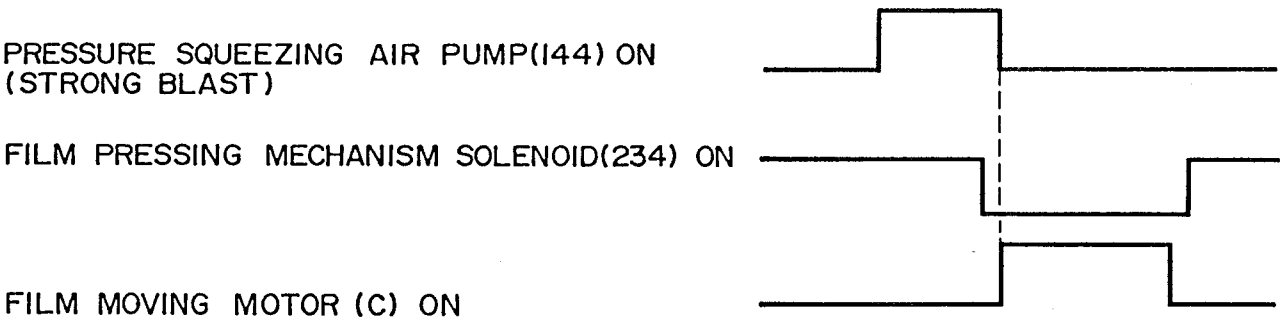
FIG. 18 is a time chart showing the relationship between the operation of the pressure squeezing air pump (144) and the frame feed step in another aspect of camera mode.

Therefore, as shown in FIG. 18, it is preferable to suspend the application of the second strong blast of air before the film moving motor (c) is driven.

What is claimed is:

1. A developing method for developing an image on an electrophotographic film by means of a processing head which has a developing section in which said image is developed under the supply of a developer, said method comprising the steps of:

(a) pressing said electrophotographic film onto said processing head;

(b) supplying said developer to said developing section;

(c) applying, for a first predetermined period, a weak blast of pressurized gas to said developing section when the supply of the developer to said developing section is finished;

(d) applying, for a second predetermined period, a first strong blast of pressurized gas stronger than said weak blast to said developing section;

(e) suspending, for a third predetermined period, the applications of both the weak blast and the first strong blast of pressurized gas;

(f) applying, for a fourth predetermined period, a second strong blast of pressurized gas stronger than said weak blast to said developing section; and (g) moving said electrophotographic film from said developing section at the earliest during the application of said second strong blast of pressurized gas to said developing section.

2. A developing method according to claim 1, wherein said third predetermined period is defined between said step (e) and said step (f).

3. A developing method according to claim 2, wherein said first predetermined period is longer than said second predetermined period.

4. A developing method according to claim 3, wherein the peripheral portion of a frame which defines said developing section is vacuum-sucked at least when said steps (a) to (c) are being executed.

5. A developing method according to claim 1, wherein the pressure of the first strong blast is substantially the same as that of the second strong blast.

6. A developing method according to claim 1, wherein said step (g) is conducted after completion of the application of said second strong blast of pressurized gas to said developing section.

7. A developing method for developing an image on an electrophotographic film by means of a processing head which has a charging/exposure section for charging and exposing said electrophotographic film, a developing section in which said image is developed under the supply of a developer, a drying section for drying developed image on said electrophotographic film, and a fixing section for fixing the dried image, said method comprising the steps of:

(a) pressing said electrophotographic film onto said processing head;

(b) supplying said developer to said developing section;

(c) applying, for a first predetermined period after completion of supply of said developer to said developing section, a weak blast of pressurized gas, to said developing section, the pressure of said gas of said weak blast being comparatively low but high enough to remove surplus developer from said developing section;

(d) applying, for a second predetermined period subsequent to said first period, a first strong blast of pressurized gas of a pressure higher than the gas of said weak blast to said developing section;

(e) suspending, for a third predetermined period subsequent to said second period, the supply of said gas, (f) applying, for a fourth predetermined period subsequent to said third predetermined period, a second strong blast of pressurized gas of a pressure higher than the gas of said weak blast to said developing section; and (g) moving said electrophotographic film from said developing section at the earliest during the application of said second strong blast of pressurized gas to said developing section.

8. A developing method according to claim 7, wherein said first predetermined period is longer than said second predetermined period.

9. A developing method according to claim 7, wherein the peripheral portion of a frame which defines said developing section is vacuum-sucked at least when said steps (a) to (c) are being executed.

10. A developing method according to claim 7, wherein said step (g) is conducted after completion of the application of said second strong blast of pressurized gas to said developing section.

* * * * *